US009163516B2

(12) United States Patent
Oliphant

(10) Patent No.: US 9,163,516 B2
(45) Date of Patent: Oct. 20, 2015

(54) FLUID MOVEMENT SYSTEM AND METHOD FOR DETERMINING IMPELLER BLADE ANGLES FOR USE THEREWITH

(71) Applicant: Concepts ETI, Inc., White River Junction, VT (US)

(72) Inventor: Kerry N. Oliphant, Sandy, UT (US)

(73) Assignee: Concepts ETI, Inc., White River Junction, VT (US)

( * ) Notice: Subject to any disclaimer, the term of this patent is extended or adjusted under 35 U.S.C. 154(b) by 518 days.

(21) Appl. No.: 13/676,163

(22) Filed: Nov. 14, 2012

(65) Prior Publication Data

US 2013/0121804 A1 May 16, 2013

Related U.S. Application Data

(60) Provisional application No. 61/559,337, filed on Nov. 14, 2011.

(51) Int. Cl.

| | |
|---|---|
| ***F01D 5/14*** | (2006.01) |
| ***F01D 5/04*** | (2006.01) |
| ***F04D 27/02*** | (2006.01) |
| ***F04D 29/22*** | (2006.01) |
| ***F04D 29/42*** | (2006.01) |
| ***F04D 29/68*** | (2006.01) |
| ***F04D 27/00*** | (2006.01) |

(52) U.S. Cl.

CPC ..... *F01D 5/141* (2013.01); *F01D 5/048* (2013.01); *F04D 27/009* (2013.01); *F04D 27/0207* (2013.01); *F04D 29/2277* (2013.01); *F04D 29/426* (2013.01); *F04D 29/4206* (2013.01); *F04D 29/685* (2013.01)

(58) Field of Classification Search

CPC ..... F01D 5/048; F01D 5/141; F04D 27/009; F04D 27/0207; F04D 29/2277; F04D 29/4206; F04D 29/426; F04D 29/685

See application file for complete search history.

(56) References Cited

U.S. PATENT DOCUMENTS

| | | | | |
|---|---|---|---|---|
| 3,442,220 | A * | 5/1969 | Mottram et al. | 415/218.1 |
| 4,212,585 | A * | 7/1980 | Swarden et al. | 415/58.6 |
| 4,708,584 | A * | 11/1987 | Meng | 415/58.5 |
| 4,743,161 | A * | 5/1988 | Fisher et al. | 415/58.4 |
| 4,981,018 | A * | 1/1991 | Jones et al. | 60/726 |
| 4,990,053 | A * | 2/1991 | Rohne | 415/58.4 |
| 5,242,268 | A * | 9/1993 | Fukazawa et al. | 416/188 |
| 6,435,829 | B1 * | 8/2002 | Meng et al. | 416/176 |
| 6,699,008 | B2 | 3/2004 | Japikse | |
| 7,025,557 | B2 | 4/2006 | Japikse et al. | |
| 7,207,767 | B2 * | 4/2007 | Ashihara et al. | 415/71 |

* cited by examiner

*Primary Examiner* — Igor Kershteyn

(74) *Attorney, Agent, or Firm* — Downs Rachlin Martin PLLC

(57) ABSTRACT

A fluid movement system that includes an impeller having a blade with a leading edge blade tip angle determined as a function of an increase in mass flow rate due to reinjection of flow from a flow stability device located proximate to the leading edge tip of the blade. In an exemplary method, the leading edge blade tip angle can be determined based on selecting a blade incidence level based on a mass flow gain versus flow coefficient curve. Blade leading edge tip angles determined in accordance with a method of the present invention are typically greater than blade leading edge tip angles determined using traditional methods. The greater blade leading edge tip angles can lead to more robust blades designs.

25 Claims, 6 Drawing Sheets

FLUID MOVEMENT SYSTEM AND METHOD FOR DETERMINING IMPELLER BLADE ANGLES FOR USE THEREWITH

RELATED APPLICATION DATA

This application claims the benefit of priority of U.S. Provisional Patent Application Ser. No. 61/559,337, filed on Nov. 14, 2011, and titled "FLUID MOVEMENT SYSTEM AND METHOD FOR DETERMINING IMPELLER BLADE ANGLES FOR USE THEREWITH," which is incorporated by reference herein in its entirety.

FIELD OF THE INVENTION

The present invention generally relates to the field of fluid movement devices. In particular, the present invention is directed to a fluid movement system and method for determining impeller blade angles for use therewith.

BACKGROUND

A certain class of pump and compressor inlet flow stabilizing devices includes an inlet tip bleed slot located near the impeller blade leading edge that pulls off some of the flow and then re-injects it upstream of the inlet. U.S. Pat. No. 6,699,008, "FLOW STABILIZATION DEVICE" to Japikse, and U.S. Pat. No. 7,025,557, "SECONDARY FLOW CONTROL SYSTEM" to Japikse et al. are examples of this type of device. The current art uses the stabilizing devices with impeller blade inlets or inducers that are designed with a standard design approach. The current approach does not take into account the impact of the re-injected bleed flow on the inlet incidence angles and inlet diffusion of the impeller.

SUMMARY

In one implementation, the present disclosure is directed to an apparatus for moving a fluid. The apparatus includes a housing, an impeller rotatable within the housing, the impeller having a blade with a leading edge blade tip angle, and a fluid stabilizing device disposed within the housing, the fluid stabilizing device being configured to remove a portion of the fluid from proximate the impeller and reinjecting the fluid at an upstream location, wherein the reinjecting of the fluid produces an increase in mass flow rate through the impeller, and wherein the leading edge blade tip angle is determined as a function of the increase in mass flow rate.

In another implementation, the present disclosure is directed to an apparatus having a low flow coefficient. The apparatus includes a housing, a high diffusion impeller rotatably engaged within the housing, the high diffusion impeller having a blade with a leading edge blade tip angle; and a fluid stabilizing device disposed within the housing, the fluid stabilizing device being configured to remove a portion of the fluid from proximate the impeller and transmitting the fluid to an upstream location and to an outer periphery of the housing, wherein the transmission of the fluid produces an increase in mass flow rate through the impeller, and wherein the leading edge blade tip angle is determined as a function of the increase in mass flow rate.

In still another implementation, the present disclosure is directed to a method of determining a leading edge blade angle of a blade for a fluid movement device that includes a fluid stability device. The method includes selecting a design flow coefficient; generating a mass flow gain curve based upon, at least, the increased flow produced by the fluid stability device; identifying a degree of incidence regulation based upon at least a local slope of the mass flow gain curve; selecting an incidence angle as a function of the degree of incidence regulation possible at the chosen design flow coefficient; and determining the leading edge blade angle as a function of the incidence level. 13724308.6

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

The present invention is directed to a device and method for expanding the stable fluid flow operational capabilities of a fluid movement device, such as a pump or compressor, having a flow stability device. At a high level, a design that takes into account the increase flow from the flow stability device can have a larger blade angle (as measured from the tangential direction) for a more open impeller inlet. Among the advantages that may accrue from the opened impeller inlet are: a) an increase in passage area; b) a reduction in inlet blade blockage; c) an increase in cavitation margin for pumps; d) an increase in choke side range without degrading turn down; and e) an increase in impeller efficiency depending on the particulars of the blade loading and local health of the boundary layer. Moreover, the impeller blades can be thicker for increased structural and modal frequencies margin without a large impact on the passage area and without sacrificing range or suction performance.

Figure 1:
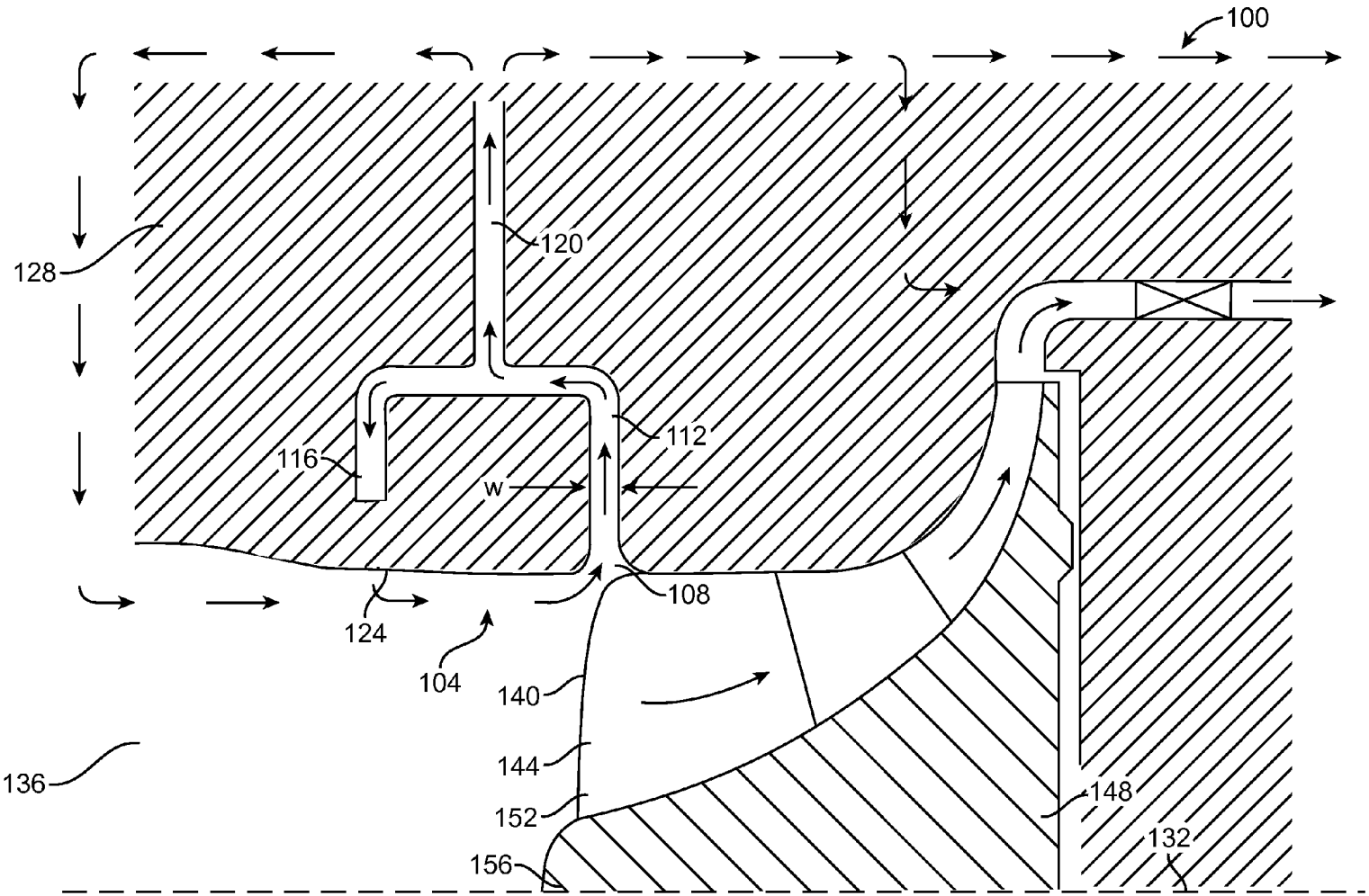
FIG. 1 is a side section view of a portion of a fluid movement device according to an embodiment of the present invention.

Turning now to FIG. 1, in an exemplary embodiment of flow device 100 (only half of which is shown for clarity), the flow device includes flow stability device 104 for reducing the velocity and increasing the static pressure of a fluid flowing through a system. Flow stability device 104 of the present invention can be retrofitted to many open or closed impeller inducer pump configurations (e.g., configurations with or without a shroud) or other equipment including bladed inducers or impellers (e.g., air-handling equipment). In an embodiment, flow stability device 104 is a substantially radial slot diffuser that is placed around the inducer at a suitable position along the internal flow channel of the pump housing. In this way, flow stability device 104 can provide an alternate path for the cavitated flow resulting from an unstable part-span (sometimes called tip) vortex that causes the instability of the impeller flow path. In this example, the inlet to the diffuser slot forms a substantially contiguous ring around the inducer and is followed by a channel, of substantially radial design, that provides a diffuser for the part-span vortex which naturally migrates radially away from the inducer axis due to its angular momentum. The substantially radial slot has a length that is selected to provide effective diffusion and to appropriately raise the static pressure.

In the case of a cavitating flow, which is trapped at the core of the vortex, the rise in static pressure causes the cavitating flow to be substantially collapsed and/or condensed from vapor back to liquid phase. Sufficient pressure recovery is achieved in the diffuser slot to return the fully condensed flow back into the inlet flow path via re-entry slots/holes and/or to the inlet plenum or downstream via return slots/holes. In the case of an unstable air flow, the diffuser slot helps to stabilize the flow by drawing at least a portion of the vortex or other unstable flow away from the inlet area thereby improving the upstream flow channel conditions.

As shown in FIG. 1, flow stability device 104 includes an inlet 108, a diffuser slot 112, and one or more passages (passages include one or more re-entry slots 116 and/or one or more return slots 120). Inlet 108 is formed in the internal sidewalls 124 of a housing 128 and leads into diffuser slot 112. Diffuser slot 112 can be vaneless and substantially radial with respect to a centerline axis 132 of a flow channel 136 and generally forms an annular ring that encircles the flow channel. Diffuser slot 112 leads to at least one re-entry slot 116 and/or at least one return slot 120 that are also formed in sidewalls 124 of housing 128.

The centerlines of inlet 104 and diffuser slot 112 are located in flow channel 136 along housing sidewall 124. Inlet 104 and diffuser slot 112 are disposed near a blade leading edge 140 of an inducer blade 144, the inducer blade being joined with an impeller 148. The one or more re-entry slots 116 can form a pathway from diffuser slot 112 to an area of flow channel 136 immediately upstream of an inducer region 152 (i.e., the region formed by blade leading edge 140 and a hub 156 of impeller 148).

In prior art systems, rotating, swirling, vortical, cavitating, or other unstable flow conditions are found adjacent to and within inducer region 152. Consequently, re-injection of diffused flow from re-entry slot 116 in the region of flow channel 136 upstream of inducer region 152 can assist with reducing the amount of rotation in the area of re-injection, thereby reducing upstream flow corruption from the unstable flow within inducer region 152.

As one of skill in the art would appreciate, given the number of different types of fluid movement device designs and their respective unstable flow characteristics, the specific dimensions and location of flow stability device 104 are selected based on the characteristics of the flow and the vortex within the flow (often influenced by inducer design) and the specific requirements for the diffuser slot 112 (e.g., controlling or stabilizing unstable flow, and/or extending the cavitation performance of the pump, etc.). Other variables that impact the specific dimensions of flow stability device 104 include the dimensions of flow channel 136, impeller 148, and inducer blade 144, as well as the flow rate parameters.

Although many variables impact the location and specific dimensions of flow stability device 104, some general rules for determining 1) the width (W) of diffuser slot 112 and 2) the location of the centerline of diffuser slot 112 with respect to blade leading edge 140 of inducer blade 144 include the following: the width (W) is related to the vane or blade height of inducer blade 144 (or other bladed/vaned mechanism) at inlet 108 of diffuser slot 112. Further explanation and examples of flow stability devices 104 and their design may be found in U.S. Pat. No. 6,699,008, "FLOW STABILIZATION DEVICE" to Japikse and U.S. Pat. No. 7,025,557, "SECONDARY FLOW CONTROL SYSTEM" to Japikse et al., which are incorporated by reference herein for their discussions of the same.

Flow stabilizing devices, such as flow stability device 104 and the devices outlined in U.S. Pat. No. 6,699,008 noted above, extract flow from proximate the inlet tip section of impeller 148 and re-inject it upstream (FIG. 1). The additional flow just upstream of blade leading edge 140 due to flow stability device 104 establishes the stability device flow gain, K, which can be defined as one plus the ratio of the re-injection flow to the upstream flow, as shown in the following equation:

$$K = 1 + \frac{\dot{m}_{re-injection}}{\dot{m}_{upstream}} \quad \{1\}$$

wherein:

$\dot{m}_{re-injection}$ is the flow from flow stability device 104; and $\dot{m}_{upstream}$ is the flow from upstream of impeller 148.

The flows (i.e., re-injection and upstream) are primarily functions of the upstream flow coefficient, the stability device losses, and the leading edge tip blade angle.

Figure 2:
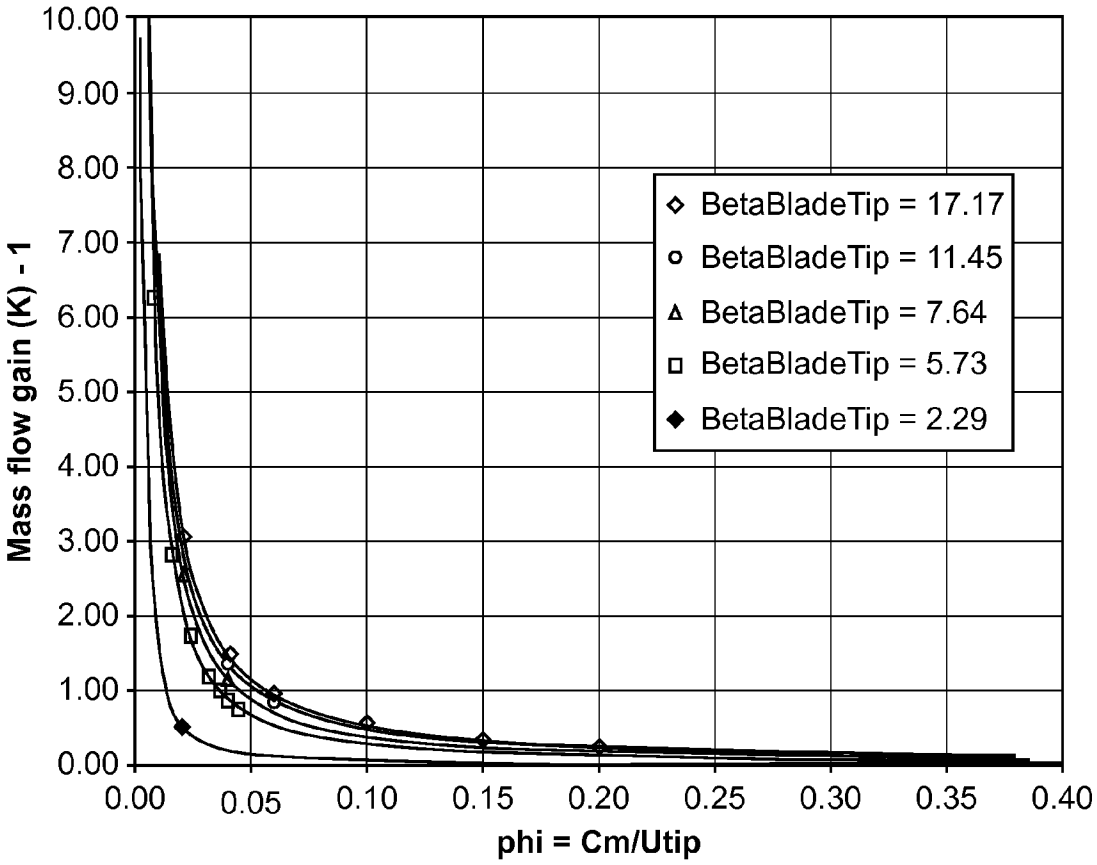
FIG. 2 is a graph of mass flow gain versus flow coefficient for multiple leading edge tip blade angles.

FIG. 2 is a plot of the stability flow gain, K, as a function of flow coefficient for several impeller blades 148, where each impeller blade has a different inlet tip blade angle. As shown in FIG. 2, a power law relationship is seen between the stability flow gain, K, and the upstream flow coefficient, of the form set forth in the following equation:

$$K=A/\phi^{B}+C \quad \{2\}$$

Where:

A is a value representative of the leading edge tip blade angle and the total pressure loss associated with the flow stabilizing device;

$\phi$ is the flow coefficient defined as the ratio of the bulk inlet meridional velocity to the inlet impeller tip speed;

B is a value representative of the leading edge tip blade angle and the total pressure loss associated with the flow stabilizing device, e.g., flow stability device 104; and C is a value representative of the leading edge tip blade angle and the total pressure loss associated with the flow stabilizing device.

In Equation 2, coefficients A, B, and C are functions of the leading edge tip blade angle and the design of the flow stabilizing device, in particular, its total pressure loss. Typical values of A, B, and C are about 0.04 and about 1.1 and about 1.0, respectively. The stability flow gain, K, of flow stability device 104 goes from about 1.1 at high flow coefficients to over 10 at very low flow coefficients.

In general, impeller blades (such as impeller blade 148 of FIG. 1) that are designed for high suction or good cavitation performance have flow coefficients of less than about 0.15. With decreasing flow rates and positive levels of incidence, the inlet of the impeller blades acts as a diffuser and contributes to part of the pressure rise in the pump. Conversely, with increasing flow rates the incidence drops and eventually goes negative such that the inlet section of the impeller blades turns into a nozzle with a corresponding pressure drop that lowers the pressure rise in the stage.

As shown in FIG. 2, for systems including a flow stability device, such as flow stability device 104 of FIG. 1, the stability flow gain, K, starts to increase the flow rate upstream from the blade leading edge of a traditionally designed impeller such that the local incidence at the blade leading edge is lower than the typical two to three degrees of incidence found in other fluid movement systems. For example, for a fluid movement device having a flow stability device, such as flow stability device 104, with a high mass flow gain stabilizing ability, the blade leading edge incidence on a traditionally designed impeller will be less than 2 degrees of incidence and, in some instances, may go to zero degrees or even be negative, which is generally associated with a drop-off in impeller pressure rise.

Implementation of a fluid movement device with a flow stability device, such as flow device 100 of FIG. 1 with flow stability device 104, results in an overall level of diffusion from far upstream to the impeller inlet that is practically unchanged aside from the benefits (discussed in U.S. Pat. Nos. 6,699,008 and 7,025,557 noted above) that accrue from the elimination of instabilities and backflow at the inlet or the losses in the system due to pumping the fluid through the flow stabilizing device. Correspondingly, while flow stability device 104 increases the flow rate, the device does not significantly alter the shape of the pressure rise and efficiency curves because the effects of the higher flow rate is localized at the blade leading edge 140. The absolute level of the head or pressure rise curve can be shifted up or down, depending on whether or not significant backflow is present at the inlet, without considering the flow rate effects of flow stability device 104. Thus, because the general shape of the head or pressure rise curve does not change, it is not inherently obvious that adjusting the blade angles will improve the performance of the impeller in the presence of the flow stability device 104. However, because the local leading edge flow is higher than the upstream flow it is possible to increase the angle of impeller blade 148 (as seen from the tangential direction) and open up the inlet to achieve the benefits of a more open inducer.

Figure 3:
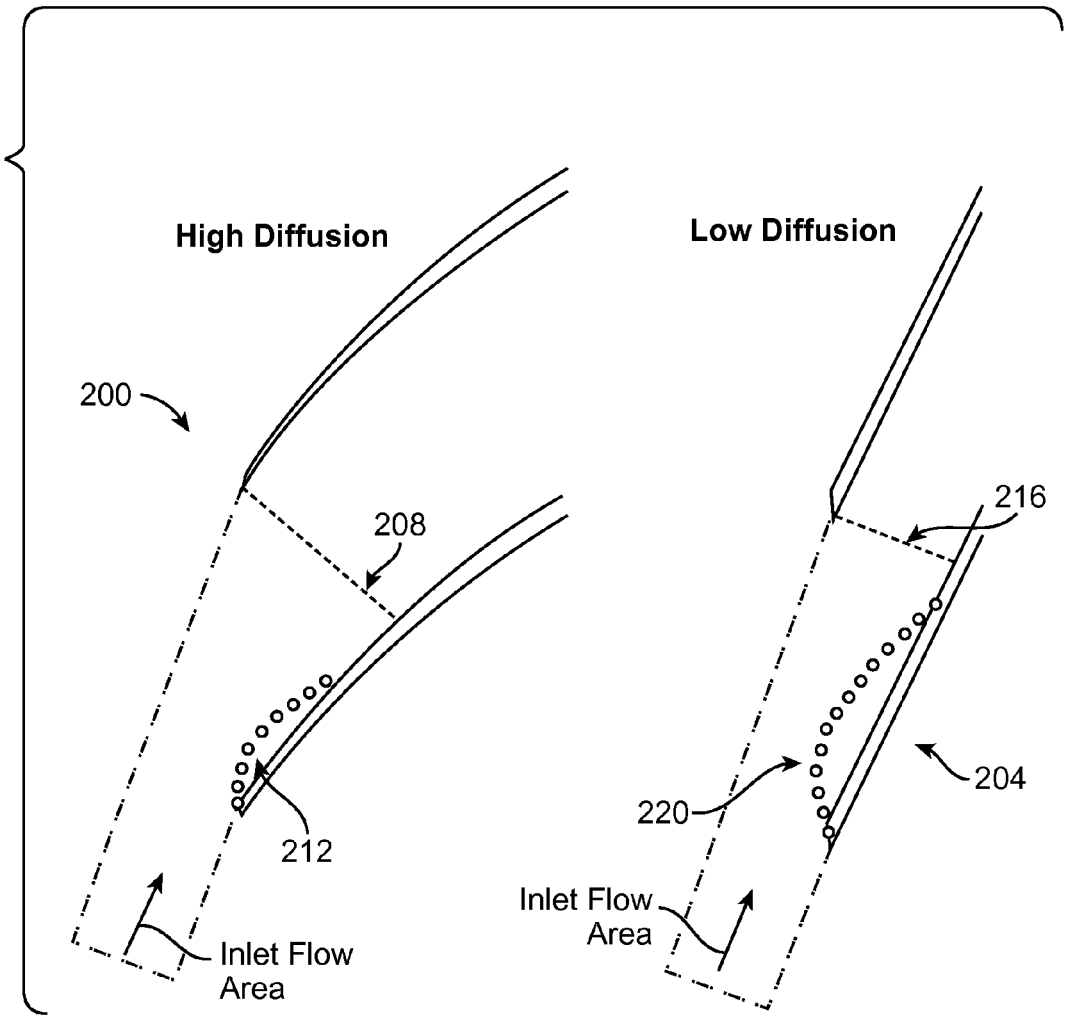
FIG. 3 is a perspective drawing of a high diffusion inducer according to an embodiment of the present invention and a low diffusion inducer.
Figure 4:
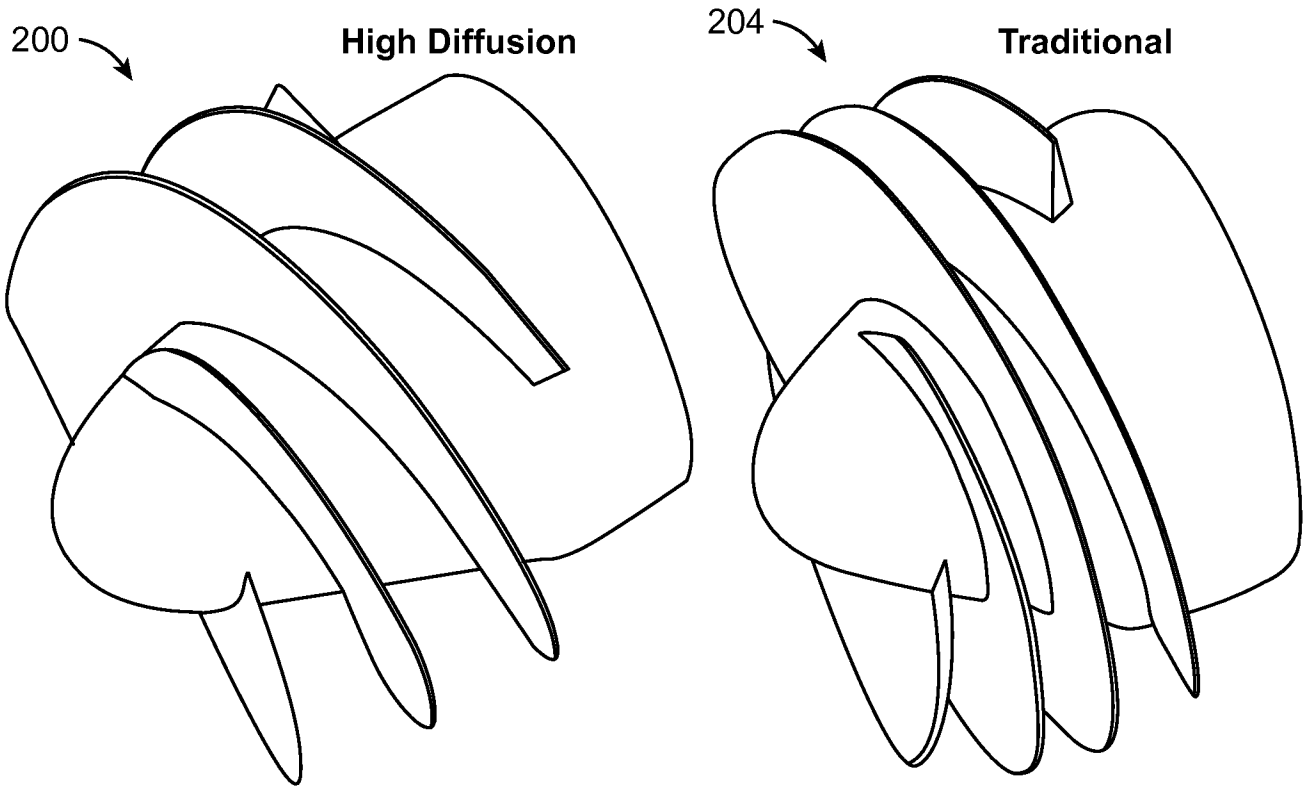
FIG. 4 is a three dimensional representation of a high diffusion inducer according to an embodiment of the present invention and a traditionally-designed inducer.

A higher blade angle inlet can be termed a high inlet diffusion inducer because the relative flow area change from far upstream to the inducer throat is greater than with traditional inducers. FIG. 3 shows a two dimensional comparison between a high inlet diffusion inducer 200 and a normal inducer 204, and FIG. 4 shows the same comparison with a three dimensional computer aided design model. Both inducers, e.g., high inlet diffusion inducer 200 and normal inducer 204, are designed for the same far upstream flow rate, but the high diffusion inducer needs to operate with the flow stabilizing device to operate without significant backflow even at the design point.

High diffusion inducer 200 improves pump cavitation performance in at least two ways. First, as seen in FIG. 3, throat area 208 of the high diffusion inducer 200 is increased so there is more room for a vapor cavity 212 to grow before filling a significant part of throat 208, which is also when the pump head decreases. Second, the pressure upstream of throat 208 is higher for high diffusion inducer 200 such that growth of the vapor cavity 212 is minimized as upstream pressure levels drop. In comparison, normal inducer 204 has a smaller throat area 216 and correspondingly less room for vapor cavity 220 growth.

In one embodiment, flow stability device 104 of FIG. 1 can be sized and configured such that at low flow coefficients the slope of the stability mass flow gain versus flow coefficient is relatively large. In this embodiment, flow stability device 104 assists in regulating the incidence on blade leading edge 140 of the inducer by facilitating proportional changes in the flow coefficient and the stability mass flow gain. An example of the incidence regulating effect of an exemplary flow stability device 104 is demonstrated in FIG. 5, which shows a Computational Fluid Dynamics (CFD) prediction of incidence on a 5.73 degree tip blade angle inducer over a plurality of flow ranges varying from about 20% to about 110% of the design point flow coefficient of 0.04.

Figure 5:
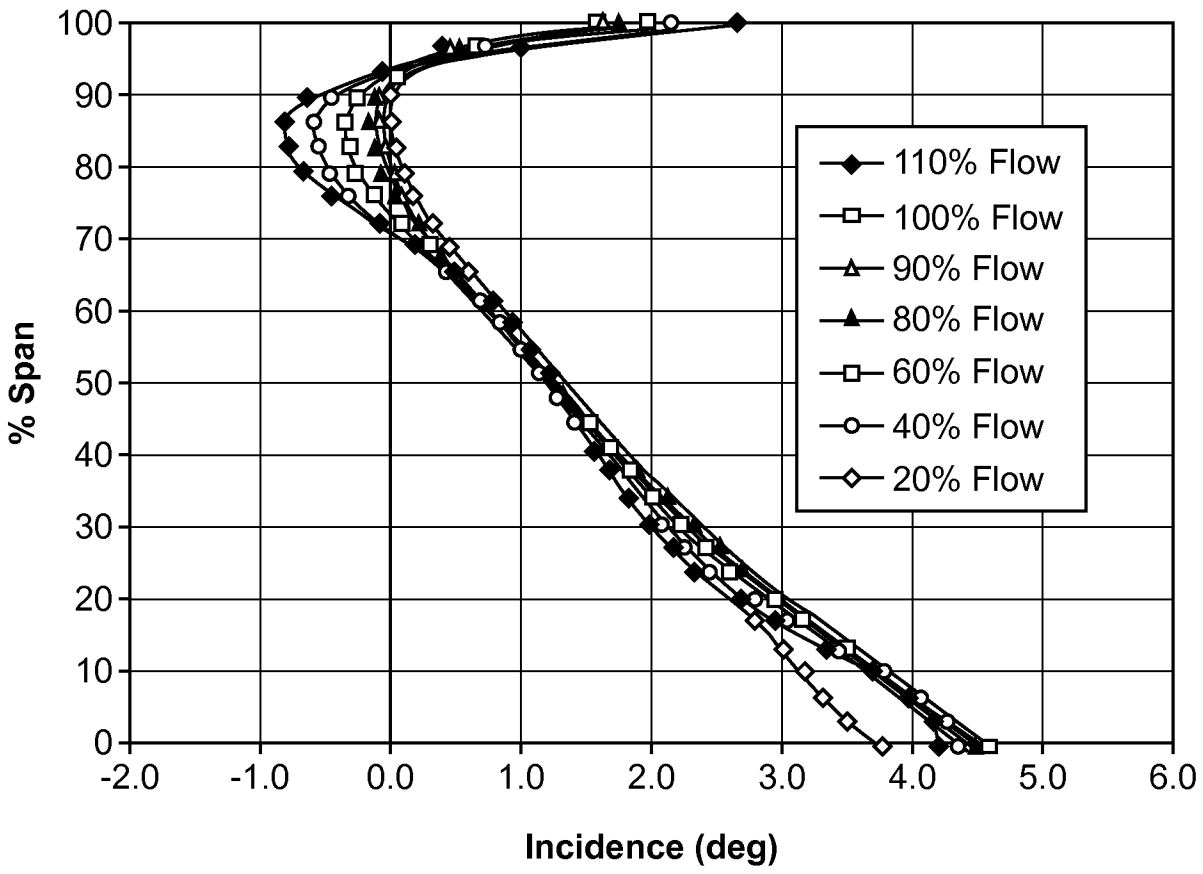
FIG. 5 is a graph of span percentage versus incidence for multiple flow rates according to an embodiment of the present invention.

The incidence angle is generally defined as the leading edge blade angle minus the inlet flow angle just upstream of the blade. As seen in FIG. 5, the incidence angle does not change by more than about 1 degree over the span from hub to shroud and for most of the span the incidence angle change is less than about 0.5 degrees. Hence, the flow angle just upstream of the blade is maintained to within about 1 degree. Additionally, while an increased incidence angle with reduced flow typically causes low flow instabilities and stall, in this embodiment the incidence angle does not increase with decreasing flow rates. Instead, flow stability device 104 of FIG. 1 controls the incidence angle, therefore allowing the blade angle to be set at a higher value (as measured from the tangential direction) without worry of low flow instability and stall.

Figure 6:
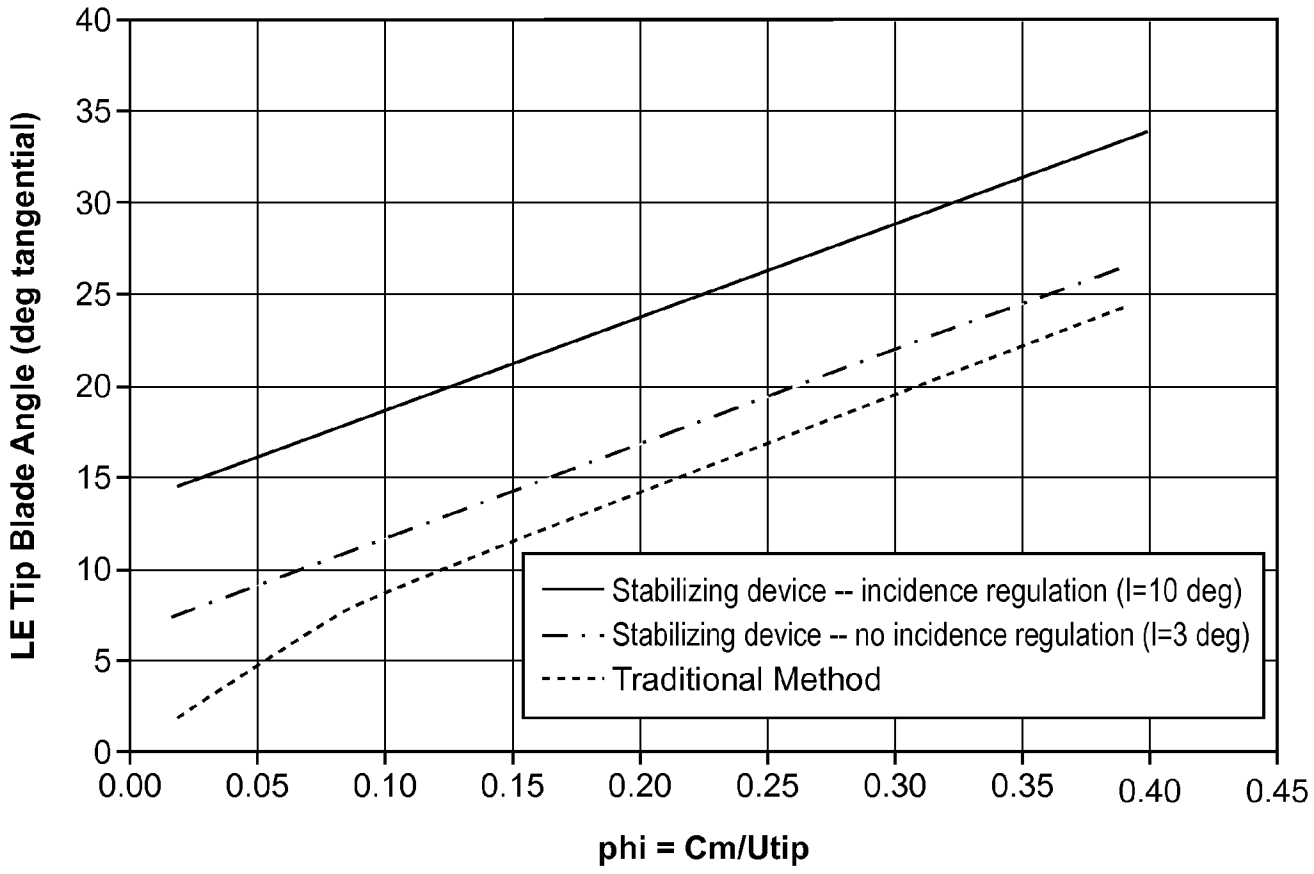
FIG. 6 is a graph of leading edge tip blade angle versus flow coefficient that compares the available leading edge tip blade angles determined under various methodologies according to an embodiment of the present invention.

Turning now to the determination of leading edge blade angle for impeller blade 148, a traditional approach for determining the leading edge blade angles for an impeller is to start with a specified flow coefficient and a design flow incidence angle. The incidence angle is determined from experience and is usually considered a trade-off between design and off-design performance. A typical value is about 2 to 3 degrees for flow coefficients greater than about 0.1. At lower flow coefficients, 3 degrees gives too much inlet diffusion, especially at off-design conditions which will cause inlet recirculation and reduced performance and stability. At low flow coefficients, an alternative approach is to specify the ratio of incidence to blade angle at the design point and a typical value for this is 0.4. FIG. 6 shows the leading edge tip blade angle versus flow coefficient for a traditional design method.

When a flow stabilizing device, such as flow stabilizing device 104 of FIG. 1, is employed with a mass flow gain similar to what is shown in FIG. 2, the leading edge tip blade angle can be increased anywhere from 2 to 13 degrees or higher over the traditional method. The design methodology is to select a design flow coefficient, determine the appropriate mass flow gain as a function of flow coefficient from curves similar to FIG. 2, and then select a maximum blade incidence level that depends on the desired level of conservatism in the design and the degree of incidence regulation (local slope in the mass flow gain curve) possible at the given flow coefficient. The blade angle at the inlet tip is then determined by Equation 3 below. The parameter AK' is a measure of the span wise non-uniformity in the flow field and can be used to get an estimate of the correct blade angle prior to using three dimensional (3D) computational fluid dynamics (CFD) calculations. Updates to these initial blade angle values can be made with 3D CFD calculations so as to fine tune the blade angle distributions.

In a conservative embodiment in which no incidence regulation is assumed, the incidence level can be set at 3 degrees. In this embodiment, the leading edge tip blade angle would have a value of 2 to 5 degrees higher than the traditional approach, which is shown in FIG. 6. In another, more aggressive, embodiment, some incidence regulation is assumed, especially at flow coefficients less than about 0.2. In this embodiment, the incidence level can be set at 10 degrees or higher because the incidence regulation will keep the incidence from going higher at lower flow rates. Thus, the increase in leading edge tip blade angle, $\beta_{blade}$, over the traditional approach would be between 9 and 13 degrees depending on the flow coefficient. The leading edge tip blade angle, $\beta_{blade}$, can be determined from the following equation:

$$\beta_{blade}=I+a\tan(AK'*K*\phi_{upstream}) \quad \{3\}$$

wherein:

I is the selected incidence angle;

K is the stability device flow gain;

$\phi_{upstream}$ is the inlet flow coefficient upstream of the stability device; and AK' is the ratio of the actual meridional velocity at the tip to the bulk flow meridional velocity calculated by dividing the mass flow rate by the inlet cross section area.

For high suction performance pumps with low flow coefficients an increase in the leading edge tip blade angle of 13 degrees will have a large impact on the suction performance because of a larger throat width. The increase in throat width, $W_{thrt}$, is approximately given by the following equation.

$$W_{thrt} \approx \frac{\sin(\beta_{blade})}{\sin(\beta_{bladeTraditional})} W_{thrt\ traditional} \quad \{4\}$$

wherein:

$\beta_{blade}$ is the leading edge tip blade angle for a fluid movement device designed with the methodology discussed above;

$\beta_{bladeTraditional}$ is the leading edge tip blade angle for a fluid movement device designed with traditional methods; and $W_{thrt\ Traditional}$ is the throat width for a traditionally designed fluid movement device.

As seen in FIG. 6, at a flow coefficient of 0.1 the traditional leading edge tip blade angle would be about 8.7 degrees and the leading edge tip blade angle with mass flow gain and incidence regulation would be about 18.7 degrees. Thus, the leading edge tip blade angle increase of 10 degrees increases the throat width by a factor of about 2.1 and significantly impacts the suction performance as well as the ability to increase the blade thickness for a more robust structural design without sacrificing suction performance.

An embodiment for a compressor is a subset of the pump case because there are no cavitation concerns. The increase in blade angle is beneficial to increase the throat area of the impeller for larger choke flow rate. In this case a typical flow coefficient would be about 0.4, which can increase the throat width from about 8% to about 33% depending on whether a incidence regulation is assumed or not. The increase in throat width significantly impacts the amount of flow that the compressor can pass and increases the mass flow rate at choke. Moreover, the increase in throat width allows for thicker, more structurally robust blades without sacrificing compressor operating range.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. An apparatus for moving a fluid, comprising:

a housing;

an impeller rotatable within said housing, said impeller having a blade with a leading edge blade tip angle; and a fluid stabilizing device disposed within said housing, said fluid stabilizing device being configured to remove a portion of the fluid from proximate said impeller and reinjecting the fluid at an upstream location, wherein the reinjecting of the fluid produces an increase in mass flow rate through said impeller, and wherein said leading edge blade tip angle is determined as a function of said increase in mass flow rate.

2. An apparatus according to claim 1, wherein said fluid stabilizing device includes an inlet and an outlet, said inlet being proximate said impeller and said outlet being at said upstream location.

3. An apparatus according to claim 2, wherein said inlet and said outlet are coupled by a fluid pathway contained within said housing.

4. An apparatus according to claim 1, wherein said inlet is a circumferential groove extending around the interior periphery of said housing.

5. An apparatus according to claim 1, wherein said outlet is a circumferential groove extending around the interior periphery of said housing.

6. An apparatus according to claim 1, further including a second outlet on the exterior periphery of said housing.

7. An apparatus according to claim 6, wherein said inlet is fluidly coupled to said outlet by a plurality of fluid pathways contained within said housing.

8. An apparatus according to claim 1, wherein a flow coefficient of the apparatus is set to less than about 0.2, said leading edge blade tip angle is about 16 degrees or higher.

9. An apparatus according to claim 1, wherein a flow coefficient of the apparatus is set to less than about 0.1, said leading edge blade tip angle is about 11 degrees or higher.

10. An apparatus according to claim 1, wherein a flow coefficient of the apparatus is set to less than about 0.4, said leading edge blade tip angle is about 27 degrees or higher.

11. An apparatus having a low flow coefficient comprising:

a housing;

a high diffusion impeller rotatably engaged within said housing, said high diffusion impeller having a blade with a leading edge blade tip angle; and a fluid stabilizing device disposed within said housing, said fluid stabilizing device being configured to remove a portion of the fluid from proximate said impeller and transmitting the fluid to an upstream location and to an outer periphery of said housing, wherein the transmission of the fluid produces an increase in mass flow rate through said impeller, and wherein said leading edge blade tip angle is determined as a function of said increase in mass flow rate.

12. An apparatus according to claim 11, wherein said fluid stabilizing device includes an inlet, a first outlet and a second outlet, said inlet being proximate said impeller, said first outlet being at said upstream location, and said second output being on the outer periphery of said housing.

13. An apparatus according to claim 11, wherein said inlet and said first outlet are circumferential grooves extending around the interior periphery of said housing and said second outlet is a circumferential groove extending around the exterior periphery of said housing.

14. An apparatus according to claim 11, wherein said inlet is fluidly coupled to said first and second outlets by a plurality of fluid pathways contained within said housing.

15. An apparatus according to claim 11, wherein a flow coefficient of the apparatus is set to less than about 0.2, said leading edge blade tip angle is about 16 degrees or higher.

16. An apparatus according to claim 11, wherein a flow coefficient of the apparatus is set to less than about 0.1, said leading edge blade tip angle is about 11 degrees or higher.

17. An apparatus according to claim 11, wherein a flow coefficient of the apparatus is set to less than about 0.4, said leading edge blade tip angle is about 27 degrees or higher.

18. A method of determining a leading edge blade angle of a blade for a fluid movement device that includes a fluid stability device, the method comprising:

selecting a design flow coefficient;

generating a mass flow gain curve based upon, at least, the increased flow produced by the fluid stability device;

identifying a degree of incidence regulation based upon at least a local slope of the mass flow gain curve;

selecting an incidence angle as a function of the degree of incidence regulation possible at the chosen design flow coefficient; and determining the leading edge blade angle as a function of the incidence level.

19. A method according to claim 18, wherein said selecting an incidence level includes consideration of the pressure recovery achieved using a diffuser slot that returns flow from proximate an impeller to an inlet flow path.

20. A method according to claim 18, wherein said selecting an incidence level includes consideration of the stabilization achieved using a diffuser slot that draws at least a portion of an unstable flow regime from an inlet of the impeller.

21. A method according to claim 18, wherein said selecting an incidence level includes consideration of the width of a diffuser slot and the location of the centerline of the diffuser slot with respect to the leading blade edge, and the height of an impeller blade.

22. A method according to claim 18, wherein the design flow coefficient is set to less than about 0.2 and the leading edge blade angle is about 16 degrees or higher.

23. A method according to claim 18, wherein the design flow coefficient of the apparatus is less than about 0.1 and the leading edge blade angle is about 11 degrees or higher.

24. A method according to claim 18, wherein the design flow coefficient is set to less than about 0.4 and the leading edge blade angle is about 27 degrees or higher.

25. A method according to claim 18, wherein said determining the leading edge blade angle, $\beta_{blade}$, includes solving the following equation:

$$\beta_{blade}=I+a\tan(AK'*K*\phi_{upstream})$$

wherein:

I is the incidence angle;

K is a stability device flow gain;

$\phi_{upstream}$ is an inlet flow coefficient upstream of the fluid stability device; and AK' is the ratio of an actual meridional velocity at a tip of the blade to a bulk flow meridional velocity calculated by dividing a mass flow rate by an inlet cross section area.

* * * * *